US006720278B2

(12) United States Patent
Wenstrup

(10) Patent No.: US 6,720,278 B2
(45) Date of Patent: Apr. 13, 2004

(54) METHOD FOR PRODUCING A SPUN-BONDED NONWOVEN WEB WITH IMPROVED ABRASION RESISTANCE

(75) Inventor: Dave E. Wenstrup, Easley, SC (US)

(73) Assignee: Milliken & Company, Spartanburg, SC (US)

( * ) Notice: Subject to any disclaimer, the term of this patent is extended or adjusted under 35 U.S.C. 154(b) by 214 days.

(21) Appl. No.: 10/099,398

(22) Filed: Mar. 15, 2002

(65) Prior Publication Data

US 2003/0173694 A1 Sep. 18, 2003

(51) Int. Cl.[7] ..... D04H 3/16

(52) U.S. Cl. ..... 442/340; 442/401; 264/13; 264/115; 264/119; 264/122; 264/123; 264/129; 264/162; 264/165

(58) Field of Search ..... 264/13, 109–128, 264/129, 162; 442/340, 401

(56) References Cited

U.S. PATENT DOCUMENTS

| | | | | | |
|---|---|---|---|---|---|
| 3,338,992 | A | | 8/1967 | Kinney | 264/24 |
| 3,341,394 | A | | 9/1967 | Kinney | 16/72 |
| 3,502,538 | A | | 3/1970 | Peterson | 161/150 |
| 3,692,618 | A | | 9/1972 | Dorschner | 161/72 |
| 3,949,128 | A | | 4/1976 | Ostermeier | 428/152 |
| 4,340,563 | A | | 7/1982 | Appel et al. | 264/518 |
| 5,399,422 | A | | 3/1995 | Dijkema et al. | 428/285 |
| 5,589,258 | A | | 12/1996 | Maddern et al. | 428/286 |
| 5,643,653 | A | | 7/1997 | Griesbach, III et al. | 428/120 |
| 5,646,077 | A | | 7/1997 | Matsunaga et al. | 442/415 |
| 5,665,300 | A | * | 9/1997 | Brignola et al. | 264/555 |
| 5,750,151 | A | * | 5/1998 | Brignola et al. | 425/66 |
| 5,786,065 | A | | 7/1998 | Annis et al. | 428/141 |
| 5,899,785 | A | | 5/1999 | Groten et al. | 442/334 |
| 5,964,742 | A | | 10/1999 | McCormack et al. | 604/380 |
| 5,970,583 | A | | 10/1999 | Groten et al. | 17/296 |
| 6,200,669 | B1 | | 3/2001 | Marmon et al. | 428/198 |

* cited by examiner

*Primary Examiner*—Stephen J. Lechert, Jr.
(74) *Attorney, Agent, or Firm*—Terry T. Moyer; Brenda D. Wentz

(57) ABSTRACT

The present invention relates to a method for improving the abrasion resistance of a spun-bonded nonwoven without substantially adversely affecting its hand or drape characteristics, by incorporating low melt binder fibers into the web during the laydown phase of the spun-bonded nonwoven production process. More specifically, improved abrasion resistance is achieved by intimately blending continuous binder fibers with the primary extruded fibers in a spun-bonded nonwoven web. Also encompassed within this invention is a spun-bonded nonwoven fabric having improved abrasion resistance and comprised of primary extruded fiber and low melt binder fiber such that the binder fiber comprises between about 1 and about 50 weight percent on weight of the spun-bonded nonwoven fabric.

29 Claims, No Drawings

METHOD FOR PRODUCING A SPUN-BONDED NONWOVEN WEB WITH IMPROVED ABRASION RESISTANCE

BACKGROUND OF THE INVENTION

The present invention relates to a method for improving the abrasion resistance of a spun-bonded nonwoven without substantially adversely affecting its hand or drape characteristics, by incorporating low melt binder fibers into the web during the laydown phase of the spun-bonded nonwoven production process. More specifically, improved abrasion resistance is achieved by intimately blending continuous binder fibers with the primary extruded fibers in a spun-bonded nonwoven web. Also encompassed within this invention is a spun-bonded nonwoven fabric having improved abrasion resistance and comprised of primary extruded fiber and low melt binder fiber such that the binder fiber comprises between about 1 and about 50 weight percent on weight of the spun-bonded nonwoven fabric.

Spun-bonded nonwoven production processes are well known in the textile arts and are described in various patents such as, for example, U.S. Pat. No. 4,692,618 to Dorschner, et al.; U.S. Pat. No. 4,340,563 to Appel, et al.; U.S. Pat. No. 3,338,992 to Kinney; U.S. Pat. No. 3,341,394 to Kinney; and U.S. Pat. No. 3,502,538 to Levy. Historically, the nonwoven webs produced from these processes have been produced for functional end-uses, such as for air filters, vehicle trunk linings, and roofing materials, with relatively low cost and little or no emphasis on the aesthetic properties of the nonwoven material.

More recently, developments in the area of spun-bonded fiber production have resulted in the creation of nonwoven fabrics with improved drape and hand characteristics ("hand" typically describes the tactile qualities of a fabric such as softness, firmness, elasticity, etc.). For example, U.S. Pat. Nos. 5,899,785 and 5,970,583, both assigned to Firma Carl Freudenberg, describe a spun-bonded nonwoven lap of very fine continuous filament and the process for making such nonwoven lap using traditional spun-bonded nonwoven manufacturing techniques. Such references disclose, as important raw materials, spun-bonded composite, or multi-component, fibers that are longitudinally splittable by mechanical or chemical action into microdenier size individual fibers. However, many fabrics made from these processes typically lack the abrasion resistance required to enter new market segments.

Some attempts have been successfully made in the past to develop methods for imparting increased abrasion resistance to nonwoven webs, but they typically provide such improved abrasion resistance with a significant reduction in textile drape and hand characteristics. For example, a textile finishing process comprised of surface and/or back coating a nonwoven web produces a web having a protective layer over its fibers for improved abrasion resistance. Similarly, one or more polymeric layers, or one or more nonwoven layers, may be laminated to one or both sides of another nonwoven layer to create a composite material possessing increased abrasion resistance. Such a composite nonwoven material is described in U.S. Pat. No. 5,399,422 to Dijkema, et al.

Other methods for improving abrasion resistance in a nonwoven web while attempting to impart acceptable fabric hand and drape characteristics involve blending binder fibers with the primary fibers of the nonwoven web using needling and carding machines to produce carded needle-punched nonwovens, as described, for example, in U.S. Pat. No. 5,646,077 to Nobuhiro, et al. Typically, a binder fiber having a substantially lower melting point than the primary fibers is selected and intimately blended with the primary fibers prior to fiber carding and web consolidation. The consolidated web is then subjected to a thermal process to activate, or melt, the intimately blended binder fibers. The binder fibers typically comprise between about 2 and 15 weight percent of the nonwoven web, which facilitates the desired result of increased abrasion resistance without a subsequent reduction in textile drape and hand. This method, however, is limited to carded needle-punched nonwoven applications and has not yet been adapted for use in spun-bonded nonwovens partly due to the difference in the raw material, i.e. staple fiber is typically used in carding processes and continuous fiber is generated in a spun-bonding process.

A further method for improving abrasion resistance and attempting to achieve acceptable hand and drape characteristics in nonwoven fabrics has been to extrude binder fibers with the primary fibers of a spun-bonded nonwoven web. For example, U.S. Pat. No. 5,643,653 to Griesbach, et al., discloses a method for extruding multi-component fibers, wherein one component is a binder fiber and the second component is a primary (non-binder) fiber. Typically, the binder fiber has a lower melting point than the primary fiber. One disadvantage of this technique, however, is an increase in the complexity of the production process as a result of having a second fiber type to process through the drying/crystallizing, extrusion, and spinning steps involved in changing polymer pellet to continuous filament fiber. This increase in complexity will likely also lead to an undesirable increase in production cost. Furthermore, the spinning of the binder fiber requires a high level of processing care to secure the desired distribution of the binder fiber without adversely affecting the weight distribution of the primary fiber.

Thus, an efficient, cost effective method is needed for incorporating low melt binder fibers into a spun-bonded nonwoven web to achieve improved abrasion resistance without compromising the drape and hand of the resulting spun-bonded nonwoven fabric. The resulting fabric may be realized in a variety of end-use products such as, for example: (a) products historically comprised of multi-layer fabric and film nonwoven composites, (b) product historically manufactured from carded, needle-punched nonwovens, and (c) new products for markets such as apparel, upholstery, drapery, and napery.

SUMMARY OF THE INVENTION

In light of the foregoing discussion, it is one object of the current invention to achieve a method for producing a spun-bonded nonwoven web having improved abrasion resistance and comprised of primary extruded fiber and low melt binder fiber such that the low melt binder fiber comprises between about 1 and about 50 weight percent on weight of the spun-bonded nonwoven web. It is preferable that the introduction of the binder fibers to the spun-bonding process does not significantly interfere with polymer spinning or web laydown. Furthermore, it is preferable, during this introduction of the binder fibers, to intimately blend the binder fibers with the primary fibers of the web so that the resulting nonwoven fabric achieves improved abrasion resistance without adversely affecting either the fabric's drape or hand characteristics, or the weight and thickness distribution of the fabric.

A further object of the current invention is to achieve a spun-bonded nonwoven fabric having improved abrasion resistance and comprised of primary extruded fiber and low melt binder fiber such that the low melt binder fiber comprises between about 1 and about 50 weight percent on weight of the spun-bonded nonwoven fabric. The fabric may be incorporated into a wide variety of end-use products, such as, for example, in articles of apparel, upholstery, napery, and drapery.

Another object of the current invention to achieve a method for producing a spun-bonded nonwoven web having improved aesthetic and/or performance characteristics and comprised of primary extruded fiber and secondary fiber or yarn such that the secondary fiber or yarn imparts the improved aesthetic and/or performance characteristics to the spun-bonded nonwoven web. The secondary fiber or yarn may be comprised, either partially or wholly, of binder fibers.

Yet a further object of the current invention is to achieve a spun-bonded nonwoven fabric having improved aesthetic and/or performance characteristics and comprised of primary extruded fiber and secondary fiber or yarn such that the secondary fiber or yarn imparts the improved aesthetic and/or performance characteristics to the spun-bonded nonwoven web. Herein again, the secondary fiber or yarn may be comprised, either partially or wholly, of binder fibers.

Other objects, advantages, and features of the current invention will occur to those skilled in the art. Thus, while the invention will be described and disclosed in connection with certain preferred embodiments and procedures, such embodiments and procedures are not intended to limit the scope of the current invention. Rather, it is intended that all such alternative embodiments, procedures, and modifications are included within the scope and spirit of the disclosed invention and limited only by the appended claims and their equivalents.

DETAILED DESCRIPTION OF THE INVENTION

The current invention discloses a method of incorporating binder fibers into a spun-bonded nonwoven web to impart improved abrasion characteristics to the resultant consolidated nonwoven web, or fabric, without substantially compromising its drape or hand characteristics. The term "outer surface layer" used below to describe a part of the nonwoven web generally refers to both of the exterior surface layers of a nonwoven web (i.e., its top surface layer and its bottom surface layer) and may be characterized by various thickness measurements depending, for example, on the weight of the nonwoven web. It is typically desirable to incorporate binder fibers into the nonwoven web to improve its abrasion resistance, but they are most desirably incorporated into the nonwoven web below the outer surface layer of the fabric so that the hand and drape of the fabric is not affected by the binder fibers, which, when exposed to thermal processing, will melt and may feel rather stiff. Thus, in contacting the outer surface layer of the fabric with one's hand, it would be preferable that one's hand contact a minimal number of binder fibers, or more preferably, no binder fibers.

The binder fibers are typically introduced into the spun web during the web laydown phase of the spun-bonded nonwoven production process in such a manner as to intimately mix with the primary extruded fibers, while at the same time being selectively prevented from generally settling on the outer surface layer of the web, or fabric, so that, in one potentially preferred embodiment, the binder fibers are substantially about 100 weight percent below the outer surface layer of the web, or fabric (on weight of the web, or fabric). However, it is also contemplated that a spun-bonded nonwoven web, having improved abrasion resistance and acceptable drape and hand properties, may be produced with binder fibers substantially about 90 weight percent below the outer surface layer of the fabric, or in another embodiment of the invention, substantially about 80 weight percent below the outer surface layer of the fabric (both weight percents determined on weight of the fabric). As mentioned above, such selectivity for the settling location of the binder fibers typically enhances the drape and hand characteristics of the spun-bonded nonwoven fabric. For example, if the binder fibers were to substantially congregate on the outer surface layer of the web, the most desirable and optimal drape and hand characteristics of the nonwoven fabric would likely not be achieved because the binder fibers, when exposed to their melting temperature, would typically form a conglomerated film of polymer, thereby reducing, or possibly eliminating, the textile-like drape and hand characteristics of the fabric. This ability to selectively locate these fibers within the formed nonwoven article is a distinct advantage over the aforementioned carded method described in U.S. Pat. No. 5,646,077 to Nobuhiro, et al.

The binder fibers are generally introduced to the web in a manner that confines linear travel of the binder fibers in either the machine direction or cross machine direction to a minimal amount, such as, for example, to about 20 millimeters or less. This may be achieved by introducing the binder fibers to the spun-bonded nonwoven production process, through the use of a controllable fiber let-off system, at a rate greater than the spun-bonded nonwoven production line speed and, simultaneously or successively, subjecting these fibers to a randomization process at the laydown section of the process. The method of randomization of these binder fibers into the laydown of the spun-bonded web can be either separate to, or incorporated as part of, the randomization of the spun-bonded web itself. Randomization may be achieved by various methods such as by controlled airflow directed at the fibers or by electrostatic techniques. Electrostatic techniques take advantage of the inherent charge imparted to a fiber during the spinning process, and this characteristic may be used to coordinate a fiber's electrostatic charge with an opposite charge located below the nonwoven receiving belt during the laydown process to assist in distributing the fiber throughout the nonwoven web. A second controllable fiber let-off system may be employed that imparts transitional movement for the cross machine distribution of fiber. More specifically, a direct drive let-off system is preferable to facilitate binder fiber introduction at a rate of greater than 100% of the spun-bonded nonwoven production line speed.

The primary extruded fibers of the spun-bonded nonwoven web may be unitary, single component fibers, multicomponent fibers, or any combination thereof. The multicomponent fibers may be splittable along their length by mechanical or chemical action. For example, U.S. Pat. Nos. 5,899,785 and 5,970,583, both assigned to Firma Carl Freudenberg and both incorporated herein by reference, describe a spun-bonded nonwoven lap of very fine continuous filament and the process for making such nonwoven lap using traditional spun-bonded nonwoven manufacturing techniques. Such references disclose, as important raw materials, spun-bonded composite, or multi-component, fibers that are longitudinally splittable by mechanical or chemical action. One example of mechanical action includes subjecting the spun-bonded nonwoven lap, or fabric, formed from such materials to high-pressure water jets (i.e., hydroentanglement) in order to separate the multicomponent filaments into their individual filaments.

The primary extruded fibers may be of any fiber size, but they are preferably characterized by having a fiber size of less than 5 denier. Further, the primary extruded fibers, when extruded as multi-component fibers, may be preferably characterized by having individual filament sizes of less than 1 denier.

The primary extruded fibers may be comprised of various fiber types including polyester, such as, for example, polyethylene terephthalate, polytriphenylene terephthalate, and polybutylene terephthalate; polyamide, such as, for example, nylon 6 and nylon 6,6; polyolefins, such as, for example, polypropylene, polyethylene, and the like; polyaramides, such as, for example, Kevlar®; polyurethanes; polylactic acid; and any combination thereof.

In selecting the appropriate binder fibers for a given end-use product, it is generally preferred to choose a binder fiber that will not be significantly activated (i.e., that will not begin to melt) during the web laydown stage, but that will perform optimally in subsequent thermal processing when activation is desired. The low melt binder fibers of the spun-bonded nonwoven web may be unitary, single component fibers, multi-component fibers, or any combination thereof. The multi-component fibers may be splittable along their length by mechanical or chemical action. Binder fibers of the current invention may be comprised of fibers selected from the group consisting of polyester, such as, for example, polyethylene terephthalate, polytriphenylene terephthalate, and polybutylene terephthalate; polyolefin, such as, for example polypropylene, polyethylene, and the like; and combinations thereof.

In one potentially preferred, non-limiting embodiment of the current invention, a polyester fiber having a melting point between about 100 and about 215 degrees C., may be selected as the binder fiber. In another potentially preferred, non-limiting embodiment of the current invention, a polyester fiber having a melting point of between about 110 and about 200 degrees C. may be selected. Alternatively, a polyethylene fiber with a melt temperature of between about 100 and about 150 degrees C., or a polypropylene fiber with a melt temperature of between about 130 and about 190 degrees C., may be employed.

The binder fiber of choice may be introduced to the spun-bonded nonwoven web from a number of different sources, including, for example, preformed fiber cones, packs or beams; spun fiber cones, packs, or beams; slit film cones, packs, or beams; or any other method whereby a controlled amount of fiber may be introduced at a controlled rate of speed to a textile manufacturing process. In one potentially preferred, non-limiting embodiment of the current invention, the binder fiber may be introduced from preformed cones or packs of fiber at a predetermined rate to facilitate the introduction of between about 1 and 50 weight percent binder fiber to the spun-bonded nonwoven web. Furthermore, these preformed packs may be warped or beamed to the appropriate number of ends to facilitate the binder fibers introduction into the spun-bonded nonwoven production process at the appropriate weight percentage.

As previously mentioned, one potentially preferred, non-limiting embodiment of the current invention for eliminating, or substantially reducing, the linearity in the machine direction of the binder fibers involves controlling the rate of consumption of the binder fibers. Typically, if the binder fibers are introduced to the web at a rate of consumption greater than the line speed of the spun-bonded nonwoven production line (i.e., greater than the speed of the spun-bonded nonwoven manufacturing process), then linearity in the machine direction of the binder fibers will be eliminated, or substantially reduced. For example, a direct driven let-off system for the binder fiber packs or beams may be used to allow binder fiber introduction at a rate greater than the spun-bonded nonwoven production line speed. This direct driven let-off may be set at a rate of between about 101 and about 200% of the spun-bonded nonwoven production line speed. In a further embodiment, this let-off may be set at a rate of between about 110 and about 150% of the spun-bonded nonwoven production line speed.

In determining the amount of low melt binder fiber to be added to the spun-bonded nonwoven web, several factors should be considered. Those factors typically include: (i) the rate of fiber consumption as determined by the binder fiber let-off drive settings, (ii) the number of binder fibers being introduced (e.g., one end or multiple ends simultaneously being introduced to the web), and (iii) the spun-bonded nonwoven base weight (usually measured in grams per square meter) and width desired for a particular end-use product. In one potentially preferred, non-limiting embodiment of the current invention, the binder fiber may comprise between about 1 and about 50 weight percent on weight of the spun-bonded nonwoven fabric. In another potentially preferred, non-limiting embodiment, the binder fiber may comprise between about 2 and about 30 weight percent on weight of the spun-bonded nonwoven fabric, and in yet a further potentially preferred, non-limiting embodiment, the binder fiber may comprise between about 3 and about 15 weight percent on weight of the spun-bonded nonwoven fabric.

Consolidation of the layered spun-bonded web with incorporated binder fiber may then be undertaken by a number of methods including but not limited to needling, hydroentanglement, chemical treatment, and thermal treatment. In deciding which consolidation method to use and in determining certain parameters of the consolidating method, emphasis should generally be placed upon maintaining the binder fibers in a non-outer surface layer arrangement in the nonwoven web. In one potentially preferred, non-limiting embodiment of the present invention, hydroentanglement with high-pressure water may be used to entangle the blended fibers with a predominance of the binder fibers arranged within the nonwoven web below the outer surface layer of the web.

Following hydroentanglement, the spun-bonded nonwoven web is subsequently and preferably subjected to thermal processing for the purpose of activating the binder fibers. In one potentially preferred, non-limiting embodiment, the web is exposed to a thermal processing range having a temperature of between about 100 and about 250 degrees C. to activate the binder fibers. In yet another potentially preferred, non-limiting embodiment, the web may be exposed to a thermal processing range having a temperature of between about 110 and about 200 degrees C. to activate the binder fibers.

Finally, the spun-bonded nonwoven web, or fabric, may be subsequently subjected to a variety of textile finishing techniques such as, for example, dyeing, printing, sanding, embossing, etc., using techniques known to those skilled in the art.

It is also contemplated to be within the scope of this invention that the method described herein for incorporating binder fibers into a spun-bonded nonwoven web may be used to incorporate other fibers or yarns ("secondary" fibers or yarns) into the web, either in place of the binder fibers or in conjunction with the binder fibers, such that the secondary fibers or yarns are between about 80 weight percent and about 100 weight percent (on weight of the web) below the outer surface layer of the nonwoven web. In other words, this method is not limited merely to the incorporation of binder fibers into a spun-bonded nonwoven web, since it may be desirable to incorporate other fiber or yarn types into the web that may impart various other aesthetic and/or performance characteristics to a spun-bonded nonwoven fabric.

For example, in order to provide a spun-bonded nonwoven web having improved aesthetic and/or performance characteristics, secondary fibers or yarns may be incorporated into the web according to the method of the current invention, and these secondary fibers or yarns may impart properties such as stretch, color, anti-microbial, odor absorbing, absorption management, flame retardance, strength, or any other desirable property, or combinations of properties, to the fabric as needed for its intended end-use. These secondary yarns or fibers may be unitary, single component fibers or yarns, multi-component fibers or yarns, or combinations thereof. They may be comprised of continuous filament fiber, spun staple yarns, spun filament yarns, or any combination thereof. Further, they may be comprised of natural fibers or yarns, synthetic fibers or yarns, or any combination thereof. Synthetic fibers or yarns are typically considered to be fibers or yarns that are chemically manufactured, while natural fibers or yarns are typically considered to be fibers or yarns that are not chemically manufactured, but rather are produced naturally, such as, for example, cotton, linen, flax, wool, etc.

The above description discloses the inventive method for producing a spun-bonded nonwoven web having improved abrasion resistance and comprised of primary extruded fiber and low melt binder fiber such that the binder fiber comprises between about 1 and about 50 weight percent on weight of the spun-bonded nonwoven fabric. Improved abrasion resistance is achieved by intimately blending low melt binder fibers with the primary extruded fibers of a spun-bonded nonwoven during the laydown step of the spun-bonded nonwoven production process. This is advantageously achieved without significantly interfering with polymer spinning or web laydown and without compromising the resulting fabric's drape and hand characteristics. Furthermore, this method may be used to incorporate secondary fibers or yarns, which may or may not include binder fibers, with primary extruded fiber to produce a spun-bonded nonwoven fabric having improved aesthetic and/or performance characteristics. Accordingly, this invention provides expanded utility within previously unavailable markets such that the fabric of the invention may be incorporated into articles of apparel, bedding, residential upholstery, commercial upholstery, automotive upholstery, napery, drapery, residential and commercial cleaning cloths, and any other article wherein it is desirable to manufacture an end-use product with these heretofore unavailable beneficial aesthetic and performance characteristics.

These and other modifications and variations to the present invention may be practiced by those of ordinary skill in the art, without departing from the spirit and scope of the present invention. Furthermore, those of ordinary skill in the art will appreciate that the foregoing description is by way of example only, and is not intended to limit the scope of the invention described in the appended claims.

I claim:

1. A method for providing a spun-bonded nonwoven web having improved abrasion resistance and comprised of primary extruded fiber and low melt binder fiber, wherein the low melt binder fiber comprises between about 1 and about 50 weight percent on weight of the spun-bonded nonwoven web, the method comprising the steps of:

(a) providing primary extruded fiber at the laydown step of the spun-bonded nonwoven production process;

(b) introducing low melt binder fiber to the primary extruded fiber of step "a" during the laydown step of the spun-bonded nonwoven production process;

(c) intimately blending the low melt binder fiber with the primary extruded fiber to provide a spun-bonded nonwoven web;

(d) activating the binder fibers contained within the spun-bonded nonwoven web; and (e) optionally, dyeing, printing, sanding, embossing, or further treating the spun-bonded nonwoven web with a textile finishing process by techniques known to those skilled in the art.

2. The method of claim 1, wherein the low melt binder fiber is introduced to the primary extruded fiber during the web laydown step of the spun-bonded nonwoven production process at a rate greater than the spun-bonded nonwoven production line speed.

3. The method of claim 1, wherein the low melt binder fiber is introduced to the primary extruded fiber during the web laydown step of the spun-bonded nonwoven production process at a rate of between about 101 and about 200 percent of the spun-bonded nonwoven production line speed.

4. The method of claim 1, wherein the low melt binder fiber is introduced to the primary extruded fiber during the web laydown step of the spun-bonded nonwoven production process at a rate of between about 110 and about 150 percent of the spun-bonded nonwoven production line speed.

5. The method of claim 1, wherein the binder fibers are activated by thermal processing at temperatures of between about 100 and about 250 degrees C.

6. The method of claim 1, wherein the binder fibers are activated by thermal processing at temperatures of between about 110 and about 200 degrees C.

7. The method of claim 1, wherein the primary extruded fiber is selected from the group consisting of unitary, single component fibers, multi-component fibers, and combinations thereof.

8. The method of claim 7, wherein the primary extruded fiber is characterized by having a fiber size of less than 5 denier.

9. The method of claim 8, wherein the primary extruded fiber is a multi-component fiber, and wherein the multi-component fiber is splittable along its length by mechanical or chemical action into individual component fibers.

10. The method of claim 9, wherein the multi-component fiber has been split along its length by mechanical or chemical action into individual component fibers, and wherein the individual component fibers are characterized by having a fiber size of less than 1 denier.

11. The method of claim 7, wherein the primary extruded fiber is comprised of fibers selected from the group consisting of polyester, polyamide, polyolefin, polyaramide, polyurethane, polylactic acid, and combinations thereof.

12. The method of claim 11, wherein the primary extruded fiber is polyester, and wherein the polyester is selected from the group consisting of polyethylene terephthalate, polytriphenylene terephthalate, polybutylene terephthalate, and combinations thereof.

13. The method of claim 11, wherein the primary extruded fiber is polyamide, and wherein the polyamide is selected from the group consisting of nylon 6, nylon 6,6, and combinations thereof.

14. The method of claim 11, wherein the primary extruded fiber is polyolefin, and wherein the polyolefin is selected from the group consisting of polypropylene, polyethylene, and combinations thereof.

15. The method of claim 1, wherein the low melt binder fiber is selected from the group consisting of unitary, single component fibers, multi-component fibers, and combinations thereof.

16. The method of claim 15, wherein the low melt binder fiber is comprised of fibers selected from the group consisting of polyester, polyolefin, and combinations thereof.

17. The method of claim 16, wherein the low melt binder fiber is polyester, and wherein the polyester is selected from the group consisting of polyethylene terephthalate, polytriphenylene terephthalate, polybutylene terephthalate, and combinations thereof.

18. The method of claim 17, wherein the low melt binder fiber is polyester, and wherein the polyester is characterized by a melting point temperature of between about 100 and about 215 degrees C.

19. The method of claim 17, wherein the low melt binder fiber is polyester, and wherein the polyester is characterized by a melting point temperature of between about 110 and about 200 degrees C.

20. The method of claim 16, wherein the low melt binder fiber is polyolefin, and wherein the polyolefin is selected from the group consisting of polypropylene, polyethylene, and combinations thereof.

21. The method of claim 20, wherein the low melt binder fiber is polypropylene, and wherein the polypropylene is characterized by a melting point temperature of between about 130 and about 190 degrees C.

22. The method of claim 20, wherein the low melt binder fiber is polyethylene, and wherein the polyethylene is characterized by a melting point temperature of between about 100 and about 150 degrees C.

23. A method for providing a spun-bonded nonwoven web having improved abrasion resistance and comprised of primary extruded fiber and low melt binder fiber, wherein the low melt binder fiber comprises between about 2 and about 30 weight percent on weight of the spun-bonded nonwoven web, the method comprising the steps of:

(a) providing primary extruded fiber at the laydown step of the spun-bonded nonwoven production process;

(b) introducing low melt binder fiber to the primary extruded fiber of step "a" during the laydown step of the spun-bonded nonwoven production process;

(c) intimately blending the low melt binder fiber with the primary extruded fiber to provide a spun-bonded nonwoven web;

(d) activating the binder fibers contained within the spun-bonded nonwoven web; and (e) optionally, dyeing, printing, sanding, embossing, or further treating the spun-bonded nonwoven web with a textile finishing process by techniques known to those skilled in the art.

24. A method for providing a spun-bonded nonwoven web having improved abrasion resistance and comprised of primary extruded fiber and low melt binder fiber, wherein the low melt binder fiber comprises between about 3 and about 15 weight percent on weight of the spun-bonded nonwoven web, the method comprising the steps of:

(a) providing primary extruded fiber at the laydown step of the spun-bonded nonwoven production process;

(b) introducing low melt binder fiber to the primary extruded fiber of step "a" during the laydown step of the spun-bonded nonwoven production process;

(c) intimately blending the low melt binder fiber with the primary extruded fiber to provide a spun-bonded nonwoven web;

(d) activating the binder fibers contained within the spun-bonded nonwoven web; and (e) optionally, dyeing, printing, sanding, embossing, or further treating the spun-bonded nonwoven web with a textile finishing process by techniques known to those skilled in the art.

25. A method for providing a spun-bonded nonwoven web having improved aesthetic and/or performance characteristics and comprised of primary extruded fiber and secondary fiber or yarn, wherein the secondary fiber or yarn imparts improved aesthetic and/or performance characteristics to the spun-bonded nonwoven web, the method comprising the steps of:

(a) providing primary extruded fiber at the laydown step of the spun-bonded nonwoven production process;

(b) introducing the secondary fiber or yarn to the primary extruded fiber of step "a" during the laydown step of the spun-bonded nonwoven production process;

(c) intimately blending the secondary fiber or yarn with the primary extruded fiber to provide a spun-bonded nonwoven web;

(d) optionally, activating any binder fibers contained within the spun-bonded nonwoven web; and (e) optionally, dyeing, printing, sanding, embossing, or further treating the spun-bonded nonwoven web with a textile finishing process by techniques known to those skilled in the art.

26. The product of the method of claim 1.

27. The product of the method of claim 23.

28. The product of the method of claim 24.

29. The product of the method of claim 25.

* * * * *